US006945402B1

(12) United States Patent
Gueret

(10) Patent No.: US 6,945,402 B1
(45) Date of Patent: Sep. 20, 2005

(54) SACHET AND ABSORBENT ITEM IN A FLEXIBLE-WALLED CONTAINER

(75) Inventor: Jean-Louis Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/720,659

(22) PCT Filed: May 4, 2000

(86) PCT No.: PCT/FR00/01200

§ 371 (c)(1),
(2), (4) Date: Mar. 2, 2001

(87) PCT Pub. No.: WO00/66455

PCT Pub. Date: Nov. 9, 2000

(51) Int. Cl.[7] ..... B66D 69/00
(52) U.S. Cl. ..... 206/581; 206/219
(58) Field of Search ..... 206/219, 204, 206/205, 210, 229, 581

(56) References Cited

U.S. PATENT DOCUMENTS

| | | | | |
|---|---|---|---|---|
| 2,907,173 A | | 10/1959 | Robbins | |
| 3,635,567 A | * | 1/1972 | Richardson, Jr. | 401/132 |
| 3,638,786 A | | 2/1972 | Borecki et al. | |
| 3,874,504 A | * | 4/1975 | Verakas | 206/219 |
| 3,887,346 A | * | 6/1975 | Erdman | 62/4 |
| 3,889,804 A | * | 6/1975 | Ravich | 206/221 |
| 4,145,449 A | * | 3/1979 | Nelham | 426/120 |
| 4,506,783 A | * | 3/1985 | Morganroth | 206/581 |
| 4,856,651 A | * | 8/1989 | Francis, Jr. | 206/219 |
| 5,058,738 A | * | 10/1991 | Svensson | 206/229 |
| 5,492,219 A | * | 2/1996 | Stupar | 206/219 |
| 5,534,020 A | * | 7/1996 | Cheney et al. | 607/108 |
| 5,548,859 A | * | 8/1996 | Oberg et al. | 8/150 |
| 5,616,337 A | | 4/1997 | Kasianovitz et al. | |
| 5,967,308 A | * | 10/1999 | Bowen | 206/219 |
| 6,062,381 A | * | 5/2000 | Paley et al. | 206/233 |
| 6,328,811 B1 | * | 12/2001 | Martin et al. | 134/6 |
| 6,393,843 B2 | * | 5/2002 | Kohout | 62/4 |

FOREIGN PATENT DOCUMENTS

| | | |
|---|---|---|
| JP | U 61-143513 | 9/1986 |
| JP | A 63-162610 | 7/1988 |
| JP | A 04-311466 | 11/1992 |
| JP | A 08-500037 | 1/1996 |
| JP | A 10-513139 | 12/1998 |
| JP | A 11-046858 | 2/1999 |
| WO | WO 94/03369 | 2/1994 |
| WO | WO 96/28262 | 9/1996 |

* cited by examiner

*Primary Examiner*—Shian T. Luong
(74) *Attorney, Agent, or Firm*—Finnegan, Henderson, Farabow, Garrett & Dunner, L.L.P.

(57) ABSTRACT

A unit for packaging at least one absorbent structure intended to be impregnated with a liquid composition includes at least one component, packaged separately from the absorbent structure. The unit includes a flexible-walled container containing the absorbent structure, and at least one sachet containing the component. The sachet is capable of opening in response to pressure exerted on the sachet via at least one flexible wall of the container so as to cause the absorbent structure to become impregnated with the liquid composition containing the component, the sachet and the absorbent structure being free inside the container. The unit may be used for treatment, particularly cosmetic treatment, of the human skin and its superficial body growths.

79 Claims, 4 Drawing Sheets

SACHET AND ABSORBENT ITEM IN A FLEXIBLE-WALLED CONTAINER

The invention relates to a unit, for example, for cosmetic treatment, comprising at least two elements to be brought into contact with one another before being applied to a support, and to the use of such a unit for applying the product obtained from the elements to the support, for example, the skin or the hair.

The unit at which the present invention is aimed is of the type comprising a flexible outer container, for example, in the form of a flexible-walled outer sachet forming a receptacle for the elements. More specifically, at least one of the elements is an inner sachet with rupturable walls, in which is packaged a liquid product that is to be kept away from the ambient air and/or from the other element. At least one of the other elements arranged in the reservoir comprises an absorbent structure. If appropriate, the reservoir may also contain a powder or paste, or alternatively another liquid.

The unit according to the invention is designed for applying a product that results from a number of separately packaged starting elements being brought into contact "in situ". In particular, the resulting product may be a mask or a wipe impregnated with at least one product, for example, a liquid. More specifically, it may be an absorbent structure, for example, of the wipe, woven gauze, nonwoven or foam type, which may or may not be impregnated with a cosmetically or dermo-pharmaceutically active agent.

The unit at which the invention is aimed can be used, for example, in the context of a treatment for preventing or treating the signs of aging of the skin, such as wrinkles and fine lines, signs of fatigue, particularly those on the face, the neck, or the décolletage, or alternatively for performing a slimming treatment on certain parts of the body. Thus, a unit such as this can be used for a slimming treatment on the hips, thighs, and/or stomach, for a breast-firming treatment, for treating cellulite and adiposity, or simply for cleaning the skin.

The parts of the face at which the invention is aimed may be wrinkles around the eyes, such as crow's-feet at the outer corners of the eyes, shadows, and bags under the eyes, wrinkles or fine lines at the corners of the mouth, etc.

A unit such as this may also be used for dying hair by oxidation or for permanent-waving hair. This kind of product is usually made up of at least two liquid components which are to be kept separately and mixed just before use and fixed on an absorbent support during use.

WO 94/03369 discloses a packaging unit comprising a flexible outer container in which are arranged two elements: a foam dental application member and an internal sachet filled with liquid. The outer container is formed of two superposed thermoplastic sheets, the edges of the first sheet being welded, in a sealed manner, to the corresponding edges of the second sheet. The internal sachet is made of a material which has a pre-weakened zone which bursts under the action of a pressure exerted via the walls of the outer container. One of the edges of the inner sachet is sandwiched and welded between two edges of the outer container, so as to immobilize the sachet inside the container.

One of the drawbacks of an arrangement such as this stems from the fact that the welding of the edge of the pouch between the edges of the outer container constitutes a weakening of the sealing, or even a risk of leakage, which may, in particular, occur before the inner pouch is opened upon application of the pressure. Furthermore, according to WO 94/03369, the choice of material of which the pouch can be made is limited because this material has to be compatible with the material of which the walls of the outer container are made, even though it is desirable, in particular, for this material to be chosen according to the nature of the substance contained in the pouch.

Furthermore, this unit has the drawback that the pre-weakened zone of the pouch constitutes a risk of permeability for certain substances which may cause premature contact or deactivation of some other component present in the container. This is, in particular, the case when the substance in the pouch is a strong oxidizing or reducing agent capable of degrading the other component.

Finally, this pre-weakened zone is difficult to control so as to ensure that it ruptures at a determined pressure on the pouch. This means that the compression force needed to open it may vary from one pouch to another.

U.S. Pat. No. 2,907,173 discloses a flexible container containing a first liquid and a sachet filled with a second liquid. The sachet can rupture so as to allow the two liquids to be brought into contact with a view to obtaining a cooling mixture. Fixed to the interior walls of the container is a layer which enhances diffusion of the mixture. It is not intended for the outer container to be opened in order to access the products packaged in this container.

U.S. Pat. No. 3,638,786 describes packaging which, by exothermal reaction of several appropriate liquid components, makes it possible to obtain a hot mousse. This pack aging comprises a first outer sachet of flexible structure and containing a first liquid. In addition, a second sachet filled with a second liquid is arranged inside the first sachet. The second sachet can rupture so as to cause the two liquids to be brought into contact with a view to obtaining a foaming mixture that is to be applied to a support after the first sachet has been opened.

Elsewhere, WO 96/28262 describes a cleaning unit comprising an outer receptacle separately containing a number of cleaning cloths and a liquid with which to impregnate the cloths. The liquid is packaged in a pocket formed by a sheet and an internal face of the wall of the outer receptacle. The sheet is arranged facing the cloths. It comprises opening means to cause the liquid to flow out over the cloths. This unit is limited in its use to liquids of low viscosity. The impregnation of the cloths, at least initially, is non-uniform.

One of the objects of the present invention therefore includes providing a treatment unit that makes it possible, reliably, to store separately at least one absorbent element and at least one element, preferably liquid, and to allow them to be brought into contact away from the ambient air. The invention is aimed in particular at uniform impregnation of the absorbent element by the liquid, and for this to be the case regardless of the consistency of this liquid.

Another problem that the present invention sets out to solve is that of being able to have one or more sachets inside the container and for this to be the case regardless of the nature of the material of which they are made. The sachets at which the invention is aimed must, in particular, be perfectly sealed against the product they package during transport and during the storage period.

A further object of the present invention is to provide a treatment unit suited, for example, for treating the skin or the hair, from at least two basic elements to be brought into contact with one another extemporaneously and thereafter applied to the skin or to the hair.

The subject of the present invention is a unit for packaging at least one absorbent structure, for example, a wipe, a patch, or a mask. The absorbent structure may be impregnated with a liquid composition, of which at least one component, optionally liquid, is packaged separately from the said absorbent structure. The absorbent structure may be intended, after impregnation with the said liquid composition, to be applied to a support, for example, the skin or the hair. The unit may comprise a flexible-walled container containing the said absorbent structure and at least one sachet containing the at least one component. The sachet may be capable of opening in response to pressure exerted on it via the flexible walls of the container, so as to cause the absorbent structure to become impregnated with the liquid composition containing the component. The sachet and the absorbent structure may be free inside the container, and the container may be designed so that it can be opened so that the absorbent structure thus impregnated can be extracted so that it can be applied to the support.

Within the meaning of the present application, an absorbent structure is understood to mean a structure that can become impregnated with the liquid composition over at least part of its depth. Such an absorption mechanism may be by pumping, for example, capillary pumping in the pores or micropores of the absorbent structure. As a preference, the volume of liquid composition is sufficient to completely saturate the absorbent structure. Such an absorbent structure may be preimpregnated with one or more active ingredients, which may have been dehydrated. Alternatively, before being brought into contact with the component or components contained separately in the sachet, the absorbent structure may be directly in contact with one or more liquid or non-liquid components forming part of the liquid composition that is to be applied to the support.

The flexible-walled outer container must be strong enough that it does not open under the effect of the pressure that has to be exerted on its walls in order to cause the opening of the sachet(s) it contains.

Also, according to one embodiment, the container and the sachet may be closed along at least one sealed edge. The resistance of the sealed edge of the container to pressure may be significantly higher than the resistance of the sealed edge of the sachet(s) to pressure.

Thus, the elements may be brought into contact inside the container by the rupturing of at least one edge of the sachet in response to the pressure exerted on the sachet via the flexible walls of the container.

In general, the sachet or sachets may comprise at least one sheet whose edges are welded or bonded. When such a sachet is formed of a single sheet, this is folded on itself and the edges facing each other are sealed together. A sheet such as this may include a layer of appropriate material, for example, thermoplastic, or be formed of a multilayer complex sheet. The nature of the material of which such a sachet is formed may vary according to the nature of the product it contains.

As a preference, the sachet or sachets are formed of two superposed sheets, for example, rectangular, sealed together around their entire periphery.

According to another embodiment, the sachet or sachets is or are made of a thermoplastic film, at least one of the sealed edges being capable of opening in response to the pressure exerted via the flexible walls of the container. For this purpose, the width of one of the sealed edges may be less than the sealed width of the other edges. Alternatively, it is possible to perform this sealing in a Perforated way, for example, producing a goffered structure.

According to one embodiment, the container comprises a detachable portion allowing it to be opened and allowing the extraction of the absorbent structure impregnated with one or more liquid components.

According to yet another embodiment, the container comprises an opening which is closed reversibly by a self-adhesive sticker which the user removes in order to open the container and then repositions after use in order to close the container again.

According to another embodiment, the outer container may be made of at least one sheet comprising at least one thermoplastic layer. Optionally, the sheet may be made of a multilayer complex, for example, of the thermoplastic/metal/thermoplastic or the polyethylene terephthalate/polyethylene/ceramic/polyethylene (PET/PE/$SiO_x$/PE) type. This container may be embodied in a similar way to the sachet, by heat-sealing together the edges by welding. The sheet may be transparent or translucent, allowing the elements packaged in the container to be seen.

According to one embodiment of the invention, the outer container comprises a body whose dimensions are markedly greater than the dimensions of the sachet (or sachets) it contains. It advantageously has a flexibility such that once the sachet or sachets has or have been opened, manual mixing of the product from the sachet with the absorbent structure can be performed by the user. This is important when each product initially contained in the sachet(s) has a high viscosity.

According to yet another embodiment of the invention, an absorbent structure may comprise at least one layer of woven or nonwoven material, of an item of open-cell or semi-open-cell foam, or of a felt. Optionally, this layer may have a relatively small thickness, for example, a thickness ranging from about 0.1 mm to about 3 mm.

According to another embodiment of the invention, the layer of woven or nonwoven material may be formed of natural or synthetic fibres, such as fibres of cotton, rayon, viscose, or mixtures thereof with fibres of polypropylene or polyester. Thus, their ability to absorb liquid and/or their mechanical strength can be adjusted.

According to yet another embodiment of the invention, the absorbent structure is cut to shape according to the configuration of the support that is to be treated.

In order to place the absorbent structure in the container, the sachet may be folded so as to define at least two flaps between which the absorbent structure is arranged. Through this arrangement, the sachet may be made easier to open in response to compression, and the absorbent structure becomes more readily impregnated. The flaps of the sachet may delimit two distinct compartments capable of opening in response to the pressure. In this case, each compartment may contain one and the same active ingredient at the same or different concentration, or may alternatively contain different active ingredients.

Where several sachets are arranged in the container, they may be secured together by their respective welded edges.

According to one embodiment, at least one of the faces of the sachet may be in contact with an element, preferably a rigid element, capable of encouraging the sachet(s) to open in response to the pressure.

Thus, the sachet(s) may be arranged between two portions of a rigid or semi-rigid element, for example, one in the shape of a clip. In this case, the portions of the said element are deformable, particularly elastically, so as to be able to be brought closer together and cause the opening of the sachet which they enclose.

As appropriate, prior to it being brought into contact with the component contained in the sachet, the absorbent structure may be impregnated with at least one cosmetically or dermo-pharmaceutically active agent chosen from thickeners, gelling agents, surfactants, physiologically compatible solvents, water, mono- or polyalcohols, oils, pH regulators, emulsifiers, dry extracts of biological origin; collagens and their derivatives, possibly freeze-dried, agents which stimulate the microcirculation in the dermis or angiogenesis, agents for smoothing out wrinkles or proteins. This active agent may be preimpregnated into the absorbent structure or arranged around it.

According to another embodiment, the component contained in the sachet may be a liquid containing at least one cosmetically or dermo-pharmaceutically active agent chosen from vitamins, slimming agents or fat catabolizers, enzymes, moisturizing agents, anti-ageing agents, anti-wrinkle agents, UV filters, etc., more specifically chosen from vitamin C, vitamin A, vitamin E, or their derivatives, alpha- and beta-hydroxy acids or their derivatives, citric acid or its derivatives, essential oils, caffeine, kojic acid, hydroquinone, nicotinic acid esters, beta-carotene, urea, glycerol, proplylene glycol, etc.

In a container containing multiple sachets, several cosmetically or dermo-pharmaceutically active components which may be mutually incompatible or incompatible with a liquid, pasty, or solid component contained in addition to the absorbent structure directly in the container may be packaged in complete safety.

A unit according to the invention may also be used for packaging a hair dye or permanent-waving solution. In the case of a hair dye, the container may, in addition to the absorbent structure, contain dye precursors, it being possible for the sachet to contain a liquid oxidizing agent.

In the case of a permanent wave, the sachet may contain a liquid reducing agent, such as thioglycolic acid and its derivatives, and the container may contain a number of wipes configured to be impregnated with the reducing agent. Such impregnated wipes may be placed around a curler before a lock of hair is wound around it.

The flexible container may contain several sachets each containing a liquid component of the same kind or of different kinds. When the sachets contain the same component, the user may himself choose the concentration of active ingredient by causing an appropriate number of sachets to open. This may be achieved right from the start, at the time of first use, or gradually during use, for example, to increase the active ingredient concentration during a treatment cycle. In the latter instance, a number of wipes are arranged in the container.

When several sachets contain components of different and mutually incompatible natures, the mixture of these components, obtained by the user kneading the outer container, may be brought into contact with the absorbent structure. Thus, a mask may, at the same time, be impregnated with a vitamin and with an active moisturizer, these being components which in the long term would neutralize each other if they were packaged together in the same volume.

The treatment unit which has just been described can be used to apply a product that is the result of several elements of the kind mentioned above being brought into contact, particularly to treat the human skin and its superficial body growths.

For example, this treatment unit can be used for treating signs of ageing of the skin, cellulite, adiposity, afflictions of the skin, the scalp, the mucous membranes, or the nails.

Other objects of the invention will become apparent in detail upon reading the description which will follow of a number of embodiments of the invention which are given by way of purely illustrative and entirely non-limiting examples, depicted in the appended drawings.

In this drawing.

In these Figures, parts which are identical or fulfill a similar role bear the same reference numerals.

Figure 1:
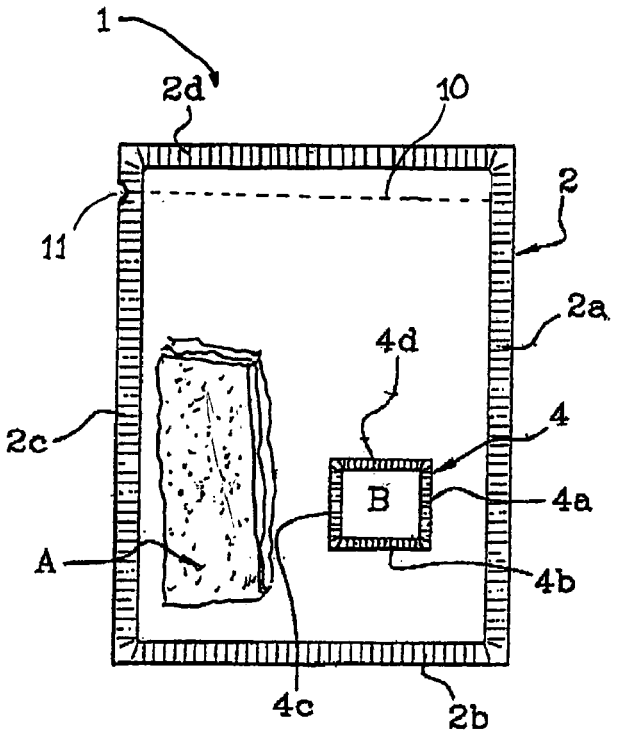
FIG. 1 depicts a diagrammatic view in axial section of a unit according to a first embodiment of the invention, comprising two elements A, B, one of which is an absorbent structure and the other of which is a liquid.

With reference to FIG. 1, there can seen a treatment unit 1 according to a first embodiment of the invention, denoted overall by the reference 1. In the course of the description of the various Figures describing other embodiments, the detailed description of parts already described with reference to the preceding Figures will not be given again.

The unit 1 comprises an outer container 2 in the form of a flexible sachet. The outer container 2 is formed of two superposed flexible sheet 3*a*, 3*b* (see FIG. 6) of roughly rectangular shape. These sheets are sealed along their respective edges 2*a*–2*d*, for example by heat-sealing welding, so as to form a sealed sachet.

The sheets 3*a* and 3*b* are flexible and each may comprise a thermoplastic layer or a complex with several thermoplastic layers comprising, as appropriate, a metallic layer, such as a film of aluminium. The choice of these sheets depends on the chemical nature of the elements arranged inside the said container.

Two elements A and B are packaged inside the outer container 2. According to the embodiment in question, the element A consists of an absorbent wipe made of a woven or nonwoven material. The wipe A can be impregnated with a liquid of greater or lesser viscosity. The wipe A may furthermore be preimpregnated with an active cosmetic or dermatological ingredient or a cosmetically or dermo-pharmaceutically acceptable excipient.

The element B is liquid and packaged in a sachet 4, which sachet is arranged freely inside the container 2. The sachet 4, distinctly smaller in size than the outer container 2, is formed of two deformable flexible sheets, sealing of which is provided by sealing the edges 4*a*–4*d*. These sheets consist of a single-layer or multi-layer material chosen according to the nature of the liquid B, to provide the best preservation conditions. At least one of the seals along the edges 4*a*–4*d* has resistance to the internal pressure of the sachet lower than the resistance that the sealed edges 2*a*–2*d* of the outer container 2 exhibit to the pressure inside the container. For this purpose, this (or these) edge(s) 4*a*–4*d* is (are) made of a narrower weld line or of a goffered or striated weld line.

The unit 1 may be manufactured as follows: two superposed sheets 3*a*, 3*b* are fixed by thermally welding the edges 2*a*, 2*c* and 2*d*. With the unit inverted, the elements A and B are introduced through the open bottom (2*b*), which can be done, as appropriate, under partial vacuum or in the presence of a protective inert gas. It must be clearly understood that other appropriate methods of manufacture may be employed.

The sachet 4 can be produced by continuous manufacture, for example, using a sheath filled with the liquid B that is to be packaged. By transversely clamping the sheath, followed by thermal welding through the stream of product, a succession of mutually aligned compartments is packaged (see also FIG. 7). These compartments need then only to be cut along the central region 5 of each weld line in order to obtain separate sachets 4 ready to be packaged in the container 2.

The outer container 2 may advantageously be made of a transparent or translucent material, allowing the user to identify the position of the sachet(s) 4.

When the user wishes to apply the product, he compresses the sachet 4 between thumb and index finger through the flexible wall of the outer container 2, so as to unfasten a weld zone of the sachet 4. In general, the opening of the sachet 4 is accompanied by an audible bursting noise, which constitutes an acoustic indicator that the component B has been released. By kneading the outer container 2, the user may, as appropriate, improve the uniform impregnation of the 10 element A with the liquid B. Having opened the outer container, for example using scissors or by tearing along a pre-weakened line 10, the impregnated element A can be extracted from the outer container and applied to the desired area. Advantageously, the pre-weakened line opens to a notch 11 making the outer container easier to open.

Figure 2:
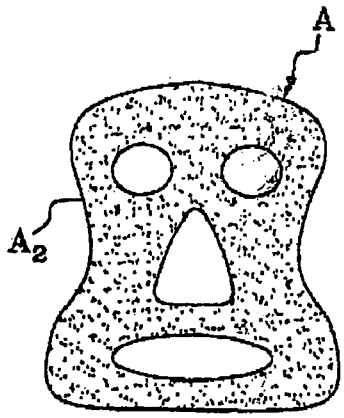
FIG. 2 depicts in detail the shape of a mask for the face, according to one particular embodiment.

FIG. 2 illustrates a shape of mask designed for treating the face, this mask being obtained by cutting a layer of woven, nonwoven, or any other absorbent material. Openings of appropriate shapes are provided for the eyes, the nose, and the mouth. This mask may be preimpregnated with gelling agents and/or other active ingredients, then dehydrated. It is desirable for the mask to be treated so that it may become sticky after it has been brought into contact with the component B. By successive folding, the mask adopts a size that allows it to be inserted into the container 2.

Upon contact with the component B, the mask rehydrates and becomes impregnated with active ingredients contained in the sachet 4. It must be clearly understood that a number of sachets 4 may be arranged in the container, which sachets contain identical components or different components.

Figure 3:
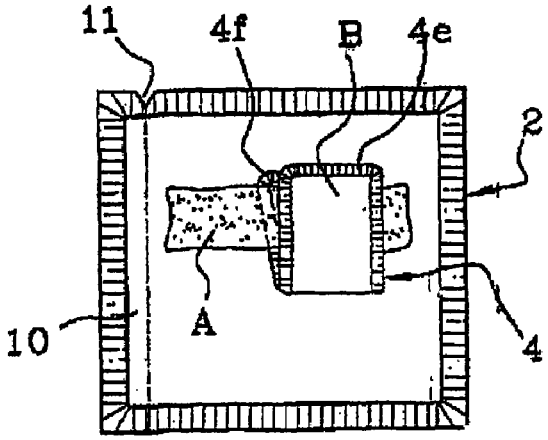
FIG. 3 depicts a diagrammatic view of a particular arrangement of the elements A and B, according to another embodiment.

FIG. 3 shows, in a similar way to the embodiment of FIG. 1, an outer container 2 in which there is a wipe A sandwiched between the two flaps 4*e*, 4*f* of a sachet 4 which is folded in two. This is because the applicant company has found that a sachet folded in this way is easier to open by compression than a sachet laid out flat.

Figure 4:
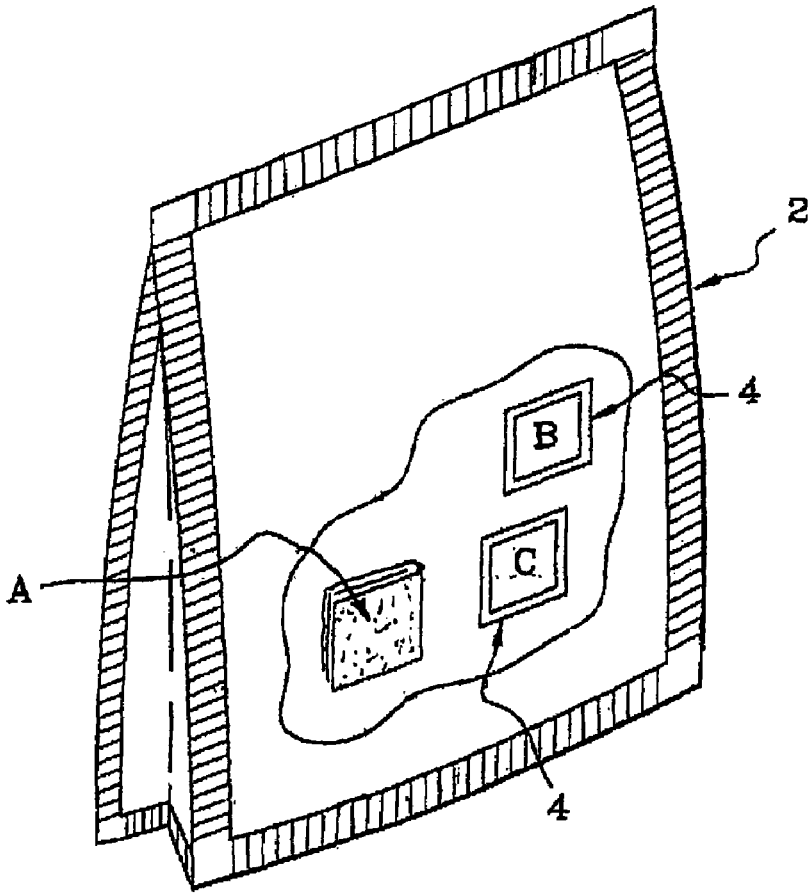
FIG. 4 depicts a perspective view, with partial cutaway, of another embodiment of the invention.

FIG. 4 illustrates, in a similar way to the embodiment of FIG. 1, the presence of a wipe A and of two sachets 4 in an outer container 2, one of which contains a component B and the second of which contains an additional component C. Advantageously, at least a portion of the container 2 is transparent or translucent so that the sachet whose contents are to be expelled can be selected. It should be noted that the outer container has a "bellows" structure, making it possible to increase its internal volume and its malleability.

Being able to place a variable number of sachets inside the container is advantageous from the industrial point of view because this makes it possible, starting from the same type of sachet (and containing the same product), to obtain final products with variable concentration and therefore activity suited to the specific requirements of the user. According to one particular mode of use, this makes it possible to perform a treatment cycle with progressive concentration. For example, the concentration in active ingredient may be increased periodically, for example, each day, by opening an additional sachet.

Figure 5:
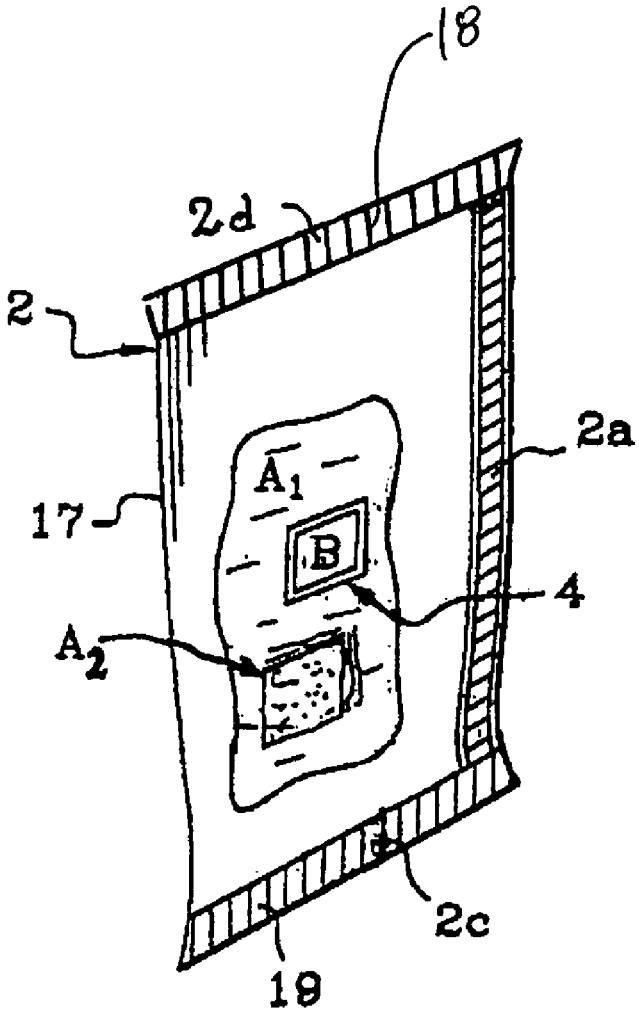
FIG. 5 depicts a perspective view, with partial cutaway, of another embodiment of the invention.

FIG. 5 illustrates another embodiment of the outer container 2. According to this embodiment, the outer container is obtained from a flexible sheath 17. The sheath 17 is formed of a sheet, for example, of thermoplastic material, and welded along a longitudinal weld line 2*a*. The sheath 17 has two opposite ends 18 and 19 obtained by transverse welds 2*c*, 2*d*, to form the bottom and top of the outer container 2.

On the inside, the outer container 2 contains a sachet 4 containing a first liquid B and an absorbent wipe $A_2$. The outer container 2 also contains a second liquid $A_1$ in which the sachet 4 and the wipe $A_2$ are "bathed". This unit therefore makes it possible, having opened the sachet 4, to impregnate the wipe $A_2$ with a mixture formed "in situ", by the components $A_1$ and B.

Figure 6:
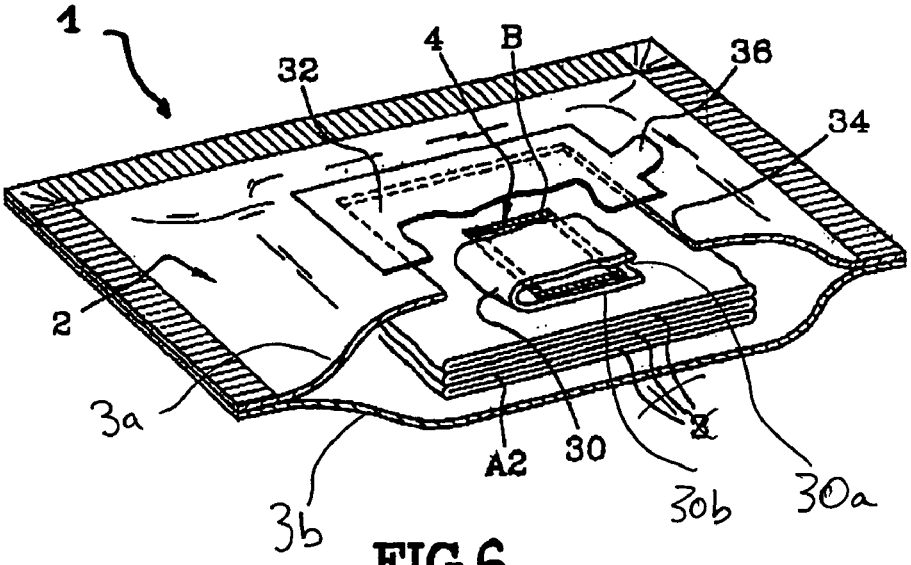
FIG. 6 depicts a perspective view, with partial cutaway, of another embodiment of the invention.

FIG. 6 depicts a unit 1 comprising, in an outer sachet 2, a number of absorbent wipes $A_2$ and a sachet 4 filled with a liquid B. By compressing the outer container 2, the sachet 4 is sandwiched between the two flaps 30*a*, 30*b* of a clip 30, made of a rigid or semi-rigid material. By compressing these two flaps 30*a*, 30*b* of the clip, the pressure exerted is spread over the entire surface of the sachet, thus making the latter easier to open and enhancing flow of the liquid B out onto the wipes. The container 2 is equipped with an opening 34, hermetically sealed by a removable, self-adhesive sticker 32. Because of its self-adhesive properties, the opening 34 can be closed again. Thus, after the sachet 4 has been opened and the wipes $A_2$ have been impregnated with the liquid B, the user can remove the sticker 32 by taking hold of a portion 36 of the sticker intended for grasping, and may extract from the container 2 a wipe which is ready for use. In order to preserve the remaining wipes, he then closes the opening 34 again by sticking the sticker back over the edges thereof.

Figure 7:
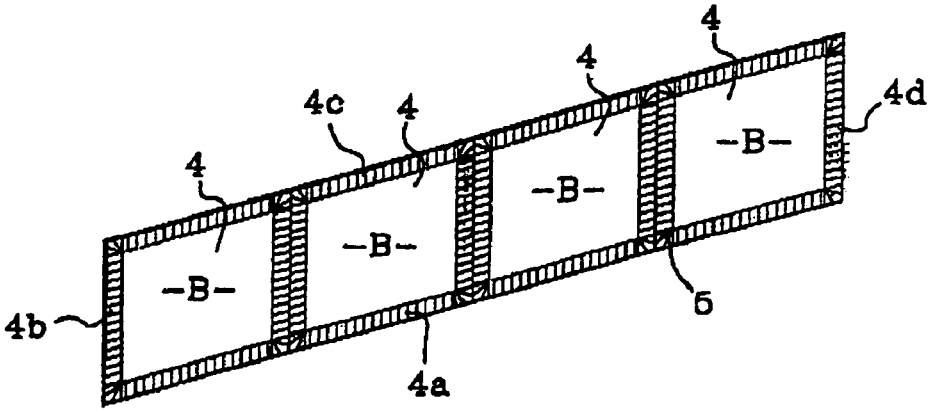
FIG. 7 depicts a perspective view of a number of sachets joined together.

FIG. 7 depicts a perspective view of a number of sachets joined together. The liquid contained in each sachet may vary as regards its nature and as regards its concentration.

The invention provides a great deal of freedom as regards the bringing of several elements of different respective nature, consistency, structure, solubility, or compatibility into contact, and does so according to varying modes of application suited to the individual requirements of the user.

Thus, the invention, in its various embodiments, may make it possible to impregnate one or more absorbent structures with at least one liquid active ingredient, to bring at least one preimpregnated absorbent structure into contact with at least one liquid active ingredient, to impregnate an absorbent structure with two liquids which are not soluble one in the other, to impregnate an absorbent structure with a mixture of several active ingredients which have to be stored separately and mixed just before their use, and to package one and the same active ingredient at varying concentrations in different sachets.

It may also be possible, when impregnating the absorbent structure, to dissolve a powder in at least one liquid component. The powder may be stable in solid form and degrade rapidly when in solution. The powder and the liquid may be arranged separately, each in one sachet. Alternatively, the powder may be arranged with the absorbent structure directly in the container and the liquid may be arranged in a sachet. Conversely, it may be possible to arrange the powder in a sachet and to package the liquid with the absorbent structure in the container.

Further, it may be possible to successively modify, in the course of a treatment cycle, the concentration of one or more liquid components, each packaged in a distinct sachet. The container may contain a number of absorbent structures. Before taking out one of the absorbent structures, all the absorbent structures arranged in the container may be impregnated with an additional component by opening at least one additional sachet.

In the foregoing detailed description, reference was made to some particular embodiments of the invention. It is obvious that variations can be made thereto without departing from the spirit of the invention as claimed hereinafter.

What is claimed is:

1. A unit for packaging at least one absorbent structure intended to be impregnated with a liquid composition including at least two different components packaged separately from the absorbent structure, the absorbent structure being intended, after impregnation with the liquid composition, to be applied to a support, the unit comprising:

a flexible-walled outer container containing the absorbent structure;

at least two inner sachets, each of said two inner sachets containing a different one of the two components, the inner sachets being capable of opening in response to pressure exerted on the inner sachets via at least one flexible wall of the outer container, so as to cause the absorbent structure to become impregnated with the liquid composition containing the components, the inner sachets and the absorbent structure being free inside the outer container, the outer container being designed to be openable so that the absorbent structure thus impregnated can be extracted in order to be applied to the support, and wherein the absorbent item is contoured in the shape of a face and includes cut-outs for a nose, mouth, and eyes.

2. The unit according to claim 1, wherein the outer container and the inner sachets are each closed along at least one respective sealed edge, the resistance of the sealed edge of the outer container to pressure being significantly higher than the resistance of the sealed edges of the sachets to pressure.

3. The unit according to claim 2, wherein at least one of the inner sachets comprises a thermoplastic film, at least one edge of at least one of the inner sachets being capable of opening under the effect of the pressure.

4. The unit according to claim 1, wherein at least one of the inner sachets includes at least one sheet including edges being one of welded and bonded.

5. The unit according to claim 1, further comprising an element capable of encouraging at least one of the inner sachets to open in response to the pressure.

6. The unit according to claim 5, wherein the element capable of encouraging the inner sachets to open includes a rigid element.

7. The unit according to claim 1, wherein the outer container is intended to be opened via a detachable portion of the outer container.

8. The unit according to claim 1, wherein the outer container comprises repositionable means for opening and closing.

9. The unit according to claim 8, wherein the repositionable means includes an adhesive sticker.

10. The unit according to claim 1, wherein the outer container comprises at least one sheet including at least one thermoplastic layer.

11. The unit according to claim 1, wherein the outer container comprises a multilayer complex chosen from a thermoplastic/metal/thermoplastic and a polyethylene terephthalate/polyethylene/ceramic/polyethylene (PET/PE/SiO/PE).

12. The unit according to claim 1, wherein at least a part of the outer container is one of transparent and translucent.

13. The unit according to claim 1, wherein the absorbent structure comprises at least one layer chosen from a woven material, a nonwoven material, an open-cell foam, a semi-open-cell foam, and a felt.

14. The unit according to claim 1, wherein the absorbent structure comprises a shape corresponding to a support that is to be treated.

15. The unit according to claim 1, wherein prior to it being brought into contact with the components contained in the inner sachets, the absorbent structure is impregnated with at least one of a cosmetically active agent and a dermo-pharmaceutically active agent chosen from thickeners, gelling agents, physiologically compatible solvents, water, monoalcohols, polyalcohols, oils, pH regulators, emulsifiers, dry extracts of biological origin, collagens and their derivatives, agents which stimulate the microcirculation of blood in a dermis or an angiogenesis, active ingredients for stretching out wrinkles, and plant proteins.

16. The unit according to claim 1, wherein the components contained in the inner sachets includes a liquid containing one of a cosmetically active agent and a dermo-pharmaceutically active agent chosen from vitamins, slimming agents, enzymes, moisturizers, and anti-ageing agents.

17. The unit according to claim 16, wherein the active agent is chosen from vitamin C, vitamin A, vitamin E, derivatives of vitamin A, derivatives of vitamin C, derivatives of vitamin E, alpha- and beta-hydroxy acids, citric acid, essential oils, caffeine, kojic acid, hydroquinone, nicotinic acid esters, beta-carotene, urea, and glycerol.

18. The unit according to claim 1, wherein the absorbent structure is one of a wipe, a patch, and a mask.

19. The unit according to claim 1, wherein at least one of the components is a liquid.

20. The unit according to claim 1, wherein the absorbent structure is configured to be applied to at least one of skin and hair.

21. A method comprising:

providing the unit of claim 1;

applying sufficient pressure to the flexible wall of the outer container to cause the inner sachets to open;

impregnating the absorbent structure with the at least one component;

removing the absorbent structure from the outer container; and placing the absorbent structure in contact with a surface region.

22. The method of claim 21, wherein the surface region includes hair and wherein the placing of the absorbent structure causes at least one of dying of the hair and permanent-waving of the hair.

23. The method of claim 21, wherein the surface region is an external body portion.

24. The method of claim 23, wherein the external body portion includes at least one of hair and skin.

25. The method of claim 21, wherein the liquid composition is one of a skin care product and a hair care product.

26. The method of claim 21, further comprising opening the outer container.

27. The method of claim 21, wherein the placing of the absorbent structure in contact with the surface region transfers liquid composition to the surface region.

28. The method of claim 21, wherein the placing of the absorbent structure includes applying the absorbent item to the surface region.

29. The method of claim 21, wherein the placing of the absorbent structure in contact with the surface region performs a treatment on the surface region.

30. The method of claim 29, wherein the treatment is a cosmetic treatment.

31. The method of claim 29, wherein the surface region includes at least one of human skin and at least one superficial body growth on human skin.

32. The method of claim 29, wherein the treatment is chosen from a treatment for limiting a sign of aging of skin, a treatment for limiting a sign of fatigue, a slimming treatment for a part of a body, a treatment for cellulite, a treatment for adiposity, and a treatment for cleaning skin.

33. The unit according to claim 1, wherein the outer container comprises a body having dimensions markedly greater than dimensions of the inner sachets such that the components of the liquid composition are capable of being manually mixed with the absorbent structure.

34. A unit for packaging at least one absorbent structure intended to be impregnated with a liquid composition including at least one component packaged separately from the absorbent structure, the absorbent structure being intended, after impregnation with the liquid composition, to be applied to a support, the unit comprising:

a flexible-walled outer container containing the absorbent structure; and at least one inner sachet containing the component, the inner sachet being capable of opening in response to pressure exerted on the inner sachet via at least one flexible wall of the outer container, so as to cause the absorbent structure to become impregnated with the liquid composition containing the component, the inner sachet and the absorbent structure being free inside the outer container, the outer container being designed to be openable so that the absorbent structure thus impregnated can be extracted in order to be applied to the support, wherein, inside the outer container, the inner sachet is folded so as to define at least two flaps between which the absorbent structure is arranged.

35. The unit according to claim 34, wherein the inner sachet comprises two distinct compartments capable of opening in response to the pressure.

36. The unit according to claim 34, wherein the at least one inner sachet comprises at least two inner sachets arranged freely inside the outer container, each of the inner sachets including a component to be incorporated into the liquid composition.

37. A system comprising:

an outer container including at least one flexible wall;

an absorbent item contained in the outer container, said absorbent item being directly in contact with at least a first component forming part of a liquid composition, wherein the absorbent item is contoured in the shape of a face and includes cut-outs for a nose, mouth, and eyes; and at least one inner sachet contained in the outer container, the at least one inner sachet containing at least a second component of said liquid composition different from said first component, and said at least one inner sachet being configured to open in response to pressure exerted on the flexible wall, wherein, when the inner sachet is opened, the absorbent item is capable of being impregnated with the second component of the liquid composition, wherein the at least one inner sachet is free within the outer container, and wherein the outer container is openable such that the impregnated absorbent item can be removed from the outer container and placed in contact with a surface region.

38. A system according to claim 37, wherein the outer container includes at least one sealed edge and the inner sachet includes at least one sealed edge, the resistance to pressure of the sealed edge of the outer container being significantly higher than the resistance to pressure of the sealed edge of the inner sachet.

39. A system according to claim 37, wherein the inner sachet includes at least one sheet including at least one sealed edge.

40. A system according to claim 39, wherein the inner sachet comprises a thermoplastic film, and wherein the at least one sealed edge is configured to be opened under the effect of the pressure exerted on the flexible wall of the outer container.

41. A system according to claim 39, wherein the edge is sealed by one of welding and bonding.

42. A system according to claim 37, further comprising an opener configured to open the inner sachet in response to the pressure exerted on the flexible wall.

43. A system according to claim 42 wherein the opener includes a rigid element.

44. A system according to claim 37, wherein the outer container includes a detachable portion for opening the outer container.

45. A system according to claim 37, wherein the outer container includes repositionable means for opening and closing.

46. A system according to claim 45, wherein the repositionable means includes an adhesive sticker.

47. A system according to claim 37, wherein the outer container includes at least one sheet having at least one thermoplastic layer.

48. A system according to claim 37, wherein the outer container comprises a material chosen from a thermoplastic/metal/thermoplastic multilayer complex and a polyethylene terephthalate/polyethylene/ceramic/polyethylene (PET/PE/SiO/PE) multilayer complex.

49. A system according to claim 37, wherein at least part of the outer container is one of transparent and translucent.

50. A system according to claim 37, wherein the absorbent item includes at least one material chosen from a woven material, a nonwoven material, open-cell foam, semi-open-cell foam, and a felt.

51. A system according to claim 37, wherein the absorbent item is contoured to a configuration of the surface region.

52. A system according to claim 37, wherein the inner sachet is folded in the outer container so as to define at least two flaps between which the absorbent item is positioned.

53. A system according to claim 52, wherein the inner sachet includes two compartments, each capable of opening in response to the pressure exerted on the flexible wall.

54. A system according to claim 37, wherein, prior to being brought into contact with the second component contained in the inner sachet, the absorbent item is impregnated with at least one of a cosmetically active agent and a dermo-pharmaceutically active agent chosen from thickeners, gelling agents, physiologically compatible solvents, water, monoalcohols, polyalcohols, oils, pH regulators, emulsifiers, dry extracts of biological origin, collagens and their derivatives, agents which stimulate the microcirculation of blood in a dermis or an angiogenesis, active ingredients for stretching out wrinkles, and plant proteins.

55. A system according to claim 37, wherein the second component contained in the inner sachet includes a liquid containing one of a cosmetically active agent and a dermo-pharmaceutically active agent chosen from vitamins, slimming agents, enzymes, moisturizers, and anti-ageing agents.

56. A system according to claim 55, wherein the active agent is chosen from vitamin C, vitamin A, vitamin E, derivatives of vitamin A, derivatives of vitamin C, derivatives of vitamin E, alpha- and beta-hydroxy acids, citric acid, essential oils, caffeine, kojic acid, hydroquinone, nicotinic acid esters, beta-carotene, urea, and glycerol.

57. A system according to claim 37, wherein the at least one inner sachet comprises at least two inner sachets arranged freely inside the outer container, each of the inner sachets comprising a component to be incorporated into the liquid composition.

58. A system according to claim 37, wherein the absorbent item is free in the outer container.

59. A method comprising:

providing the system of claim 37;

applying sufficient pressure to the flexible wall of the outer container to cause the at least one inner sachet to open;

impregnating the absorbent item with the second component;

removing the absorbent item from the outer container; and placing the absorbent item in contact with a surface region.

60. The method of claim 59, wherein the surface region is an external body portion.

61. The method of claim 60, wherein the external body portion includes at least one of hair and skin.

62. The method of claim 59, wherein the liquid composition is one of a skin care product and a hair care product.

63. The method of claim 59, further comprising opening the outer container.

64. The method of claim 59, wherein the placing of the absorbent item in contact with the surface region transfers liquid composition to the surface region.

65. The method of claim 59, wherein the placing of the absorbent item includes applying the absorbent item to the surface region.

66. The method of claim 59, wherein the placing of the absorbent item in contact with the surface region performs a treatment on the surface region.

67. The method of claim 66, wherein the treatment is a cosmetic treatment.

68. The method of claim 66, wherein the surface region includes at least one of human skin and at least one superficial body growth on human skin.

69. The method of claim 66, wherein the treatment is chosen from a treatment for limiting a sign of aging of skin, a treatment for limiting a sign of fatigue, a slimming treatment for a part of a body, a treatment for cellulite, a treatment for adiposity, and a treatment for cleaning skin.

70. The method of claim 59, wherein the surface region includes hair and wherein the placing of the absorbent item causes at least one of dying of the hair and permanent-waving of the hair.

71. The system according to claim 37, wherein the absorbent item is one of a wipe, a patch, and a mask.

72. The system according to claim 37, wherein at least one of the components is a liquid.

73. The system according to claim 37, wherein the absorbent item is configured to be applied to at least one of skin and hair.

74. The system of claim 37, wherein the outer container comprises a body having dimensions markedly greater than dimensions of the at least one inner sachet such that the components of the liquid composition are capable of being manually mixed with the absorbent item.

75. A method comprising:

providing an outer container including at least one flexible wall, an absorbent item contained in the outer container, and at least one inner sachet contained in the outer container, the at least one inner sachet containing at least a component of a liquid composition;

applying sufficient pressure to the flexible wall of the outer container to cause the at least one inner sachet to open;

impregnating the absorbent item with the component;

kneading the outer container after the at least one inner sachet is opened;

removing the absorbent item from the outer container; and placing the absorbent item in contact with a surface region.

76. The method of claim 75, wherein said placing comprises placing the absorbent item in contact with an external body portion.

77. The method of claim 75, wherein said placing of the absorbent item in contact with the surface region transfers liquid composition to the surface region.

78. The method of claim 75, wherein said placing of the absorbent item in contact with the surface region performs a treatment on the surface region.

79. A system comprising:

a container including at least one flexible wall:

an absorbent item contained in the container; and;

at least one sachet contained in the container, the at least one sachet containing at least a component of a liquid composition and being configured to open in response to pressure exerted on the flexible wall, wherein, when the sachet is opened, the absorbent item is capable of being impregnated with the component of the liquid composition, wherein the container, the at least one sachet, and the absorbent item are configured such that the container is kneadable, after the sachet is opened, in order to promote uniform impregnation of the absorbent item with the component of the lliquid composition, wherein the container is openable such that the impregnated absorbent item can be removed from the container and placed in contact with a surface region, and wherein the absorbent item is contoured in the shape of a face and includes cut-outs for a nose, mouth, and eyes.

* * * * *